US005400843A

United States Patent [19]

Gönner et al.

[11] Patent Number: 5,400,843

[45] Date of Patent: Mar. 28, 1995

[54] APPARATUS FOR CONTROLLING THE TAPER OF WOOD BOARDS FORMED BY A CHIPLESS CUTTING OPERATION

[75] Inventors: Siegmar Gönner, Oberkirch; Heinz-Hubert Braun, Oberkirch-Botenau, both of Germany

[73] Assignee: Gebrüder Linck Maschinenfabrik "Gatterlinck" GmbH & Co. KG, Oberkirch, Germany

[21] Appl. No.: 211,484

[22] PCT Filed: Apr. 7, 1992

[86] PCT No.: PCT/EP93/00865

§ 371 Date: Apr. 6, 1994

§ 102(e) Date: Apr. 6, 1994

[87] PCT Pub. No.: WO93/20986

PCT Pub. Date: Oct. 28, 1993

[30] Foreign Application Priority Data

Apr. 14, 1992 [DE] Germany ..... 42 12 432.8

[51] Int. Cl.[6] ..... B27L 9/00; B27C 1/00; B27B 1/00

[52] U.S. Cl. ..... 144/3 P; 83/870; 144/120; 144/175; 144/184; 144/357; 144/369

[58] Field of Search ..... 144/3 R, 3 P, 120, 175, 144/178, 182, 190, 184, 356, 357, 369; 83/422, 870, 774

[56] References Cited

U.S. PATENT DOCUMENTS

| | | | |
|---|---|---|---|
| 4,589,456 | 5/1986 | Traben | 144/120 |
| 4,825,917 | 5/1989 | Gonner | 144/120 |
| 5,052,452 | 10/1991 | Goenner | 144/3 P |
| 5,318,083 | 6/1994 | Gonner et al. | 144/120 |

*Primary Examiner*—W. Donald Bray

*Attorney, Agent, or Firm*—Burns, Doane, Swecker & Mathis

[57] ABSTRACT

Sheets of wood are cut from a timber piece along a guide and against a cutting blade. A transverse taper of the wood piece is measured as the wood piece is conveyed. In accordance with changes in the measured transverse taper, the guide or the blade is pivoted about an axis extending perpendicular to the blade edge as the wood piece is being conveyed. Also, the longitudinal taper of the wood piece can be measured as the wood piece is conveyed. In accordance with the changes in the measured longitudinal taper, the distance between the blade edge and the wood guide is varied as the wood piece is conveyed.

13 Claims, 4 Drawing Sheets

APPARATUS FOR CONTROLLING THE TAPER OF WOOD BOARDS FORMED BY A CHIPLESS CUTTING OPERATION

BACKGROUND OF THE INVENTION

The invention relates to a device for cutting sheets of wood off square timber without forming chips, said device comprising a machine frame and a feeding device, which conveys the square timber in the longitudinal direction against a cutter blade, slanted at an angle to said square timber, with a pressure bar, which is located at a distance from the cutter blade and is attached to a wood guide surface.

It is well-known to use, instead of the sawing method, the cutting method (DE-A-37 02 909), which does not form chips and thus functions virtually without a loss, in order to produce sheets of wood from a square timber. It is also well-known to adjust in the case of a device of the aforementioned class (DE-A-40 26 346) the thickness of the sheets of wood produced or the thin boards by changing the distance between the cutter blade and the adjacent pressure bar by means of a setting mechanism. In the prior art device this distance is set as a function of the result of the measurement of the square timber prior to each cutting operation. With this known device the thickness of each individual sheet of wood that is produced can be influenced; however, the taper cannot be influenced.

In everyday operations, however, there is a need to influence precisely the taper of the sheets of wood, which are produced, in the transverse direction, in order to compensate for a variation in thickness between both longitudinal edges of the sheet of wood.

Such a difference in the thickness of the sheet of wood in the transverse direction also occurs when the cutter blade is arranged exactly parallel to the wood guide surface. Since the sheet of wood to be cut during the cutting operation is compressed between the cutter blade and the pressure bar, which is rigidly attached to the wood guide surface, the compressibility of the wood, which is usually cut in the moist state, affects the resulting thickness of the sheet of wood.

The compressibility depends, however, on the growth ring arrangement in the cross section of the wood, and in particular, the angle at which the growth rings run with respect to the surface of the sheet of wood. Owing to the approximately circular pattern of the growth rings in the cross section of the trunk, this angle of the growth rings relative to the surface of the sheet of wood varies over the width of said sheet of wood. The result is that in most cases the thickness of the two longitudinal edges of the sheet of wood that is produced varies immediately after the cutting operation, a state that is called "taper in the transverse direction".

In the known device (DE-A-40 26 346) the setting of the cutter blade is controlled in such a manner as a function of the measured thickness of the square timber that the waste sheet, remaining after the last cutting operation exhibits, the same thickness as the other sheets of wood, thus maintaining a specified tolerance. If, however, the square timber is cut conically as a consequence of the varying compressibility in the transverse direction, these conical variations can add up in the many successive cutting operations in such a manner that the resulting waste sheet exhibits such a severe taper in the transverse direction that it is not suitable for further processing, even though its thickness is still within the permissible tolerance.

In another known device (DE-A-39 26 396) the pressure bar opposite the cutter blade is pivot-mounted on the wood guide surface. However, the pivoting motion takes place around a swivel axis, which extends in essence parallel to the cutter blade. Such a pivotability is not provided and also not suitable for compensating a taper of the square timber, especially since there is no relative adjustment between the wood guide surface and the cutter blade. Thus, in this device only the pressure conditions over the entire length of the cutter blade change uniformly. However, the thickness and/or the taper of the sheets of wood produced is not affected.

Therefore, the object of the invention is to design a device of the aforementioned class in such a manner that an error in taper resulting during the cutting operation can be automatically compensated.

SUMMARY OF THE INVENTION

This problem is solved according to the invention by arranging at a distance from each other two measurement devices for the thickness of the square timber in the transverse direction of the square timber and in that there is a relative pivoting motion between the cutter blade and the wood guide surface, which is connected to the pressure bar, around a swivel axis, which extends in essence at right angles to the cutter blade, as a function of the measurement result, determined by the measurement devices, by means of a swivel control.

A taper of the square timber in the transverse direction is determined by measuring the square timber at two measurement points, which are spaced laterally apart. The cutting operation is changed in such a manner by means of the subsequent relative pivoting motion of the cutter blade and the wood guide surface, carrying the pressure bar, that the taper of the square timber is compensated to such an extent that the remaining waste sheet does not exhibit any taper beyond the permissible amount in the transverse direction. The thickness of the waste sheet can correspond either to the thickness of the other sheets or be counted larger, thus resulting in a subsequent machining operation during which the waste sheet obtains the desired thickness.

The relative pivoting motion can be carried out in such a manner that the wood guide surface, guiding the square timber, with the pressure bar, which is attached to said wood guide surface, is rigidly mounted to the frame and that the cutter blade is attached to a cutter holder, pivot-mounted on the machine frame.

Instead of the above arrangement, the cutter blade can also be mounted rigidly on the frame and the wood guide surface, connected to the pressure bar, can be pivot-mounted on the machine frame.

In another embodiment of the inventive idea it is provided that, in addition to this relative pivoting motion between the cutter blade and the wood guide surface or independently thereof, a taper in the longitudinal direction of the square timber is also compensated. In addition, it is provided according to the invention that the distance between the cutter blade and the wood guide surface, connected to the pressure bar, can be adjusted during the passage of the square timber by means of a setting mechanism as a function of at least two measurements of the thickness of the square timber, said measurements being done at a certain longitudinal distance.

With these measurements a taper of the square timber in the longitudinal direction is determined. The distance between the cutter blade and the wood guide surface is changed in such a manner during the travel of a square timber that this lengthwise taper is compensated. The object of this measure is also that the remaining waste sheet does not exhibit any inadmissible high taper.

BRIEF DESCRIPTION OF THE DRAWINGS

The invention is explained in detail with reference to the embodiments shown in the drawings.

DETAILED DESCRIPTION OF PREFERRED EMBODIMENTS OF THE INVENTION

Figure 1:
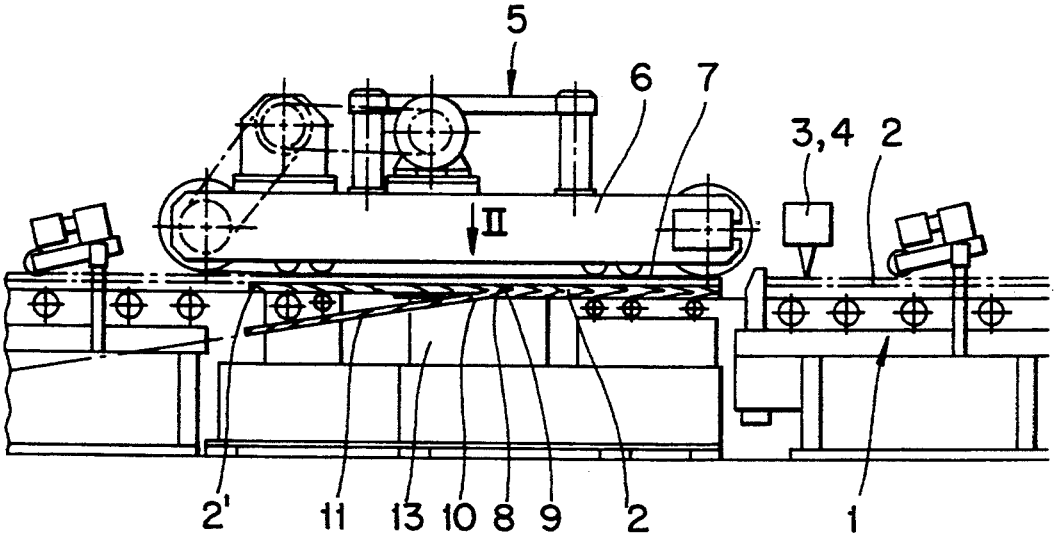
FIG. 1 is a simplified side view of a device for cutting sheets of wood off a square timber without forming chips.
Figure 2:
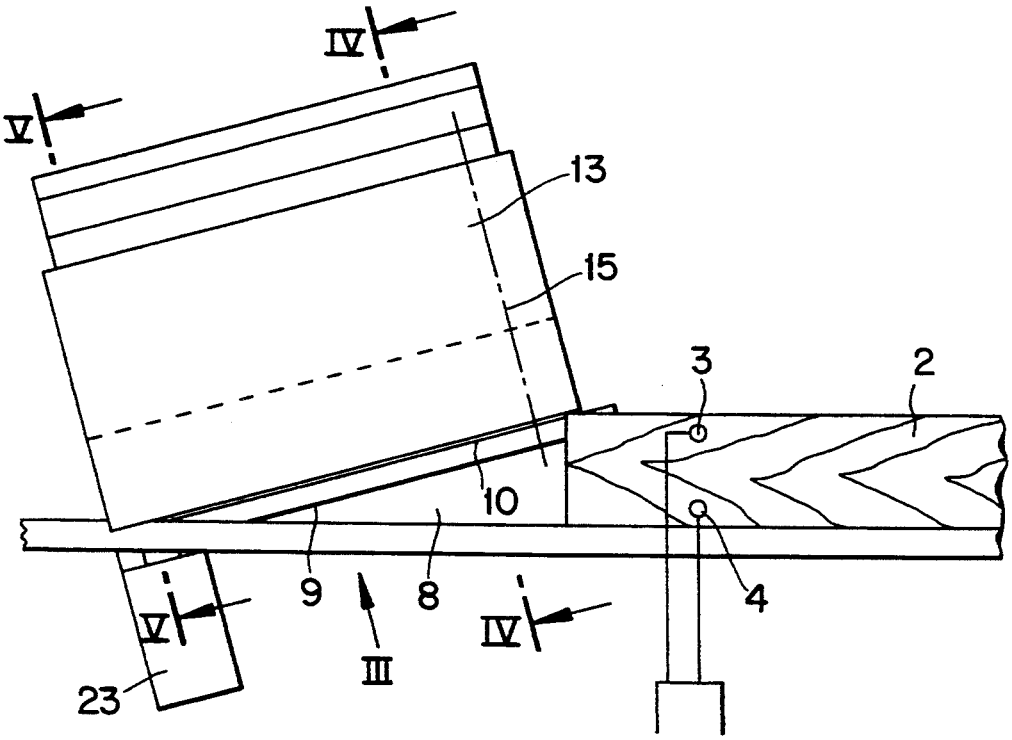
FIG. 2 is an enlarged top view of a detail in the direction of the arrow II in FIG. 1.

The device depicted in FIG. 1 exhibits a feed-conveying mechanism 1, for example a roller bed, on which a square timber 2 is fed in. Two measurement devices 3, 4, located at a distance from each other in the transverse direction of the square timber 2, for example laser-thickness measurement devices, detect the thickness of the square timber 2 at two points, which lie, as indicated in FIG. 2, side-by-side at a certain distance (as seen in the transverse direction of the square timber 2).

In a cutting station 5 the square timber 2 is pressed by a feeding device 6, which exhibits in the illustrated embodiment a driven, vertically adjustable feed belt 7, against a wood guide surface 8, which is designed as a guiding table and to whose edge is rigidly attached a pressure bar 9, which slopes at an acute angle relative to the longitudinal direction of the wood and the conveying direction of the wood.

At a distance from the pressure bar 9 or the wood guide surface 8 and in essence parallel thereto there is a cutter blade 10, against which the square timber 2 is pressed by means of the feed device 6. The cutter blade 10 cuts off the underside of the square timber 2 a sheet of wood 11, which is removed diagonally downwardly, as shown in the schematic in FIG. 1.

After leaving the cutting station 5, the remaining square timber 2' is carried away again to the feed-conveying device 1 and subjected again to a cutting operation. This procedure is repeated until only a waste sheet remains of the square timber 2 or 2'.

Figure 3:
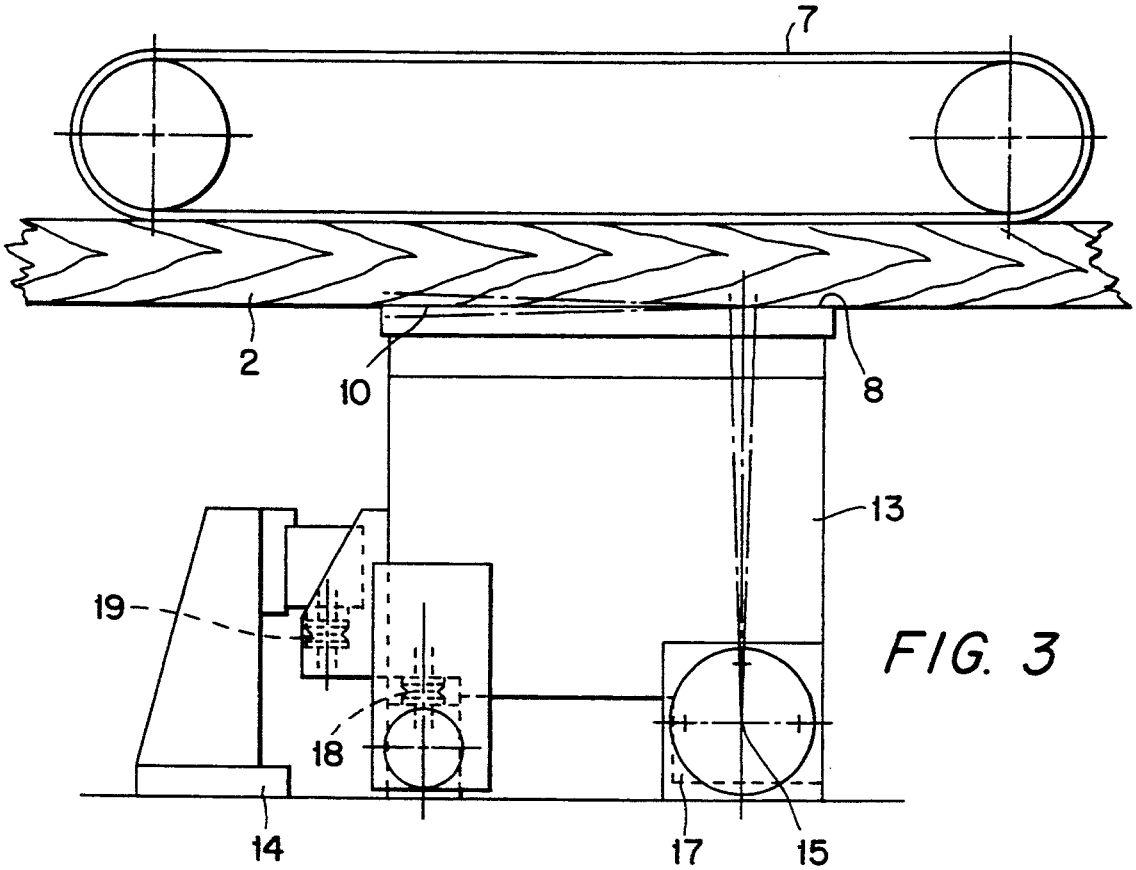
FIG. 3 is a view in the direction of arrow III in FIG. 2.
Figure 4:
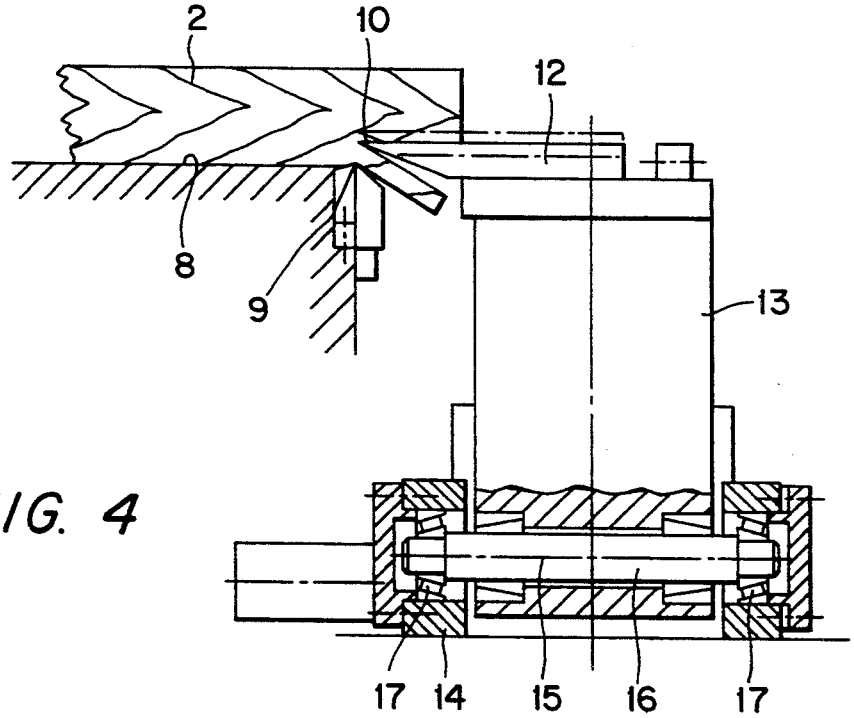
FIG. 4 is a sectional view along the line IV—IV of FIG. 2.

In the embodiment illustrated in detail in FIGS. 2 to 5, the wood guide surface 8, guiding the square timber 2, and the pressure bar 9, connected to said wood guide surface, are mounted rigidly to the frame (FIG. 4). The cutter blade 10 is designed as a cutter 12, which is attached to the top side of a cutter holder 13. The cutter holder 13 is pivot-mounted on the machine frame 14, where its horizontal swivel axis 15 extends in the top view (FIG. 2) at right angles to the cutter blade 10. The swivel axis 15 is formed by means of a shaft 16, which is attached to a box-shaped cutter holder 13 and whose two shaft ends are mounted in a swivel bearing 17 of the machine frame 14.

As evident from FIG. 3, the cutter holder 13 is braced at a distance from the swivel axis 15 against a vertically adjustable abutment 18. By means of this pressure 19 the cutter holder 13 is pressed without play against the abutment 18.

Figure 5:
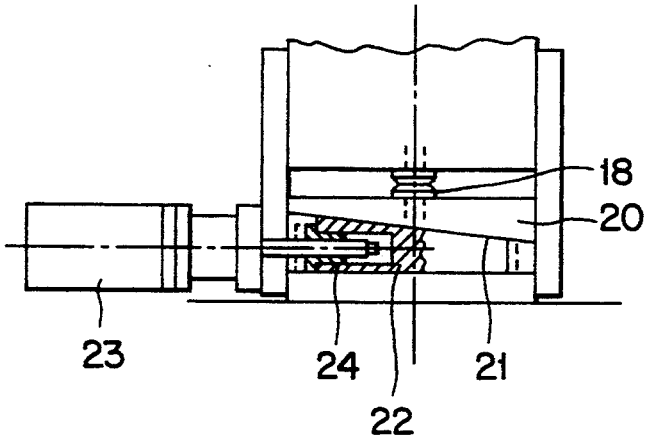
FIG. 5 is a sectional view along the line V—V of FIG. 2.

FIG. 5 shows that the abutment 18 exhibits a vertically adjustable carrier 20, whose bottom inclined surface 21 rests against a horizontally moveable wedge 22. The wedge 22 can be adjusted horizontally by way of a threaded spindle 24, connected to an adjusting motor 23, in order to be able to adjust the height of the abutment 18.

The schematic of FIG. 2 shows that the measurement results, delivered by the measurement devices 3, 4, are fed to an evaluation circuit 25. There the taper of the square timber 2 in the transverse direction is determined as the difference in the thickness at the measurement points 3, 4. The evaluation circuit 25 sends a regulate command to the adjusting motor 23, which swivels the cutter blade 10 relative to the pressure bar 9, mounted rigidly on the frame, around the swivel axis 15, in order to compensate the measured taper at least so far that the remaining waste sheet does not exhibit any inadmissible large taper in the transverse direction.

At variance with the embodiment described and illustrated in FIGS. 1-5, the cutter holder 13 can also be swivelled around another swivel axis, provided it forms only an angle with the cutter blade 10 that is clearly not 0°. For example, the cutter holder 13 can be swivelled around a swivel axis, extending in the conveying direction and the longitudinal direction of the square timber 2. Important is only that during the swivelling motion the relative angular position between the cutter blade 10 and the wood guide surface 8 or the pressure bar 9 changes.

Therefore, at variance with the embodiment described above it can also be provided that the cutter blade 10 is attached rigidly to the frame and the wood guide surface 8 performs the controlled swivelling motion.

Figure 7:
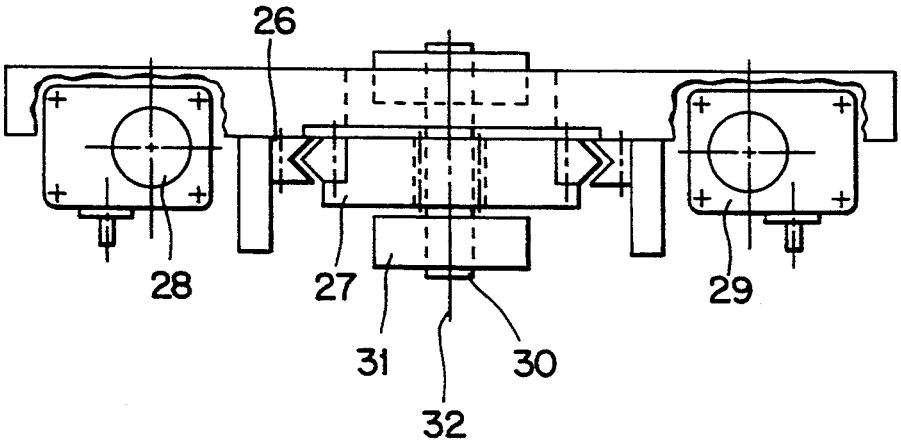
FIG. 7 is a sectional view along the line VII—VII of FIG. 6.
Figure 6:
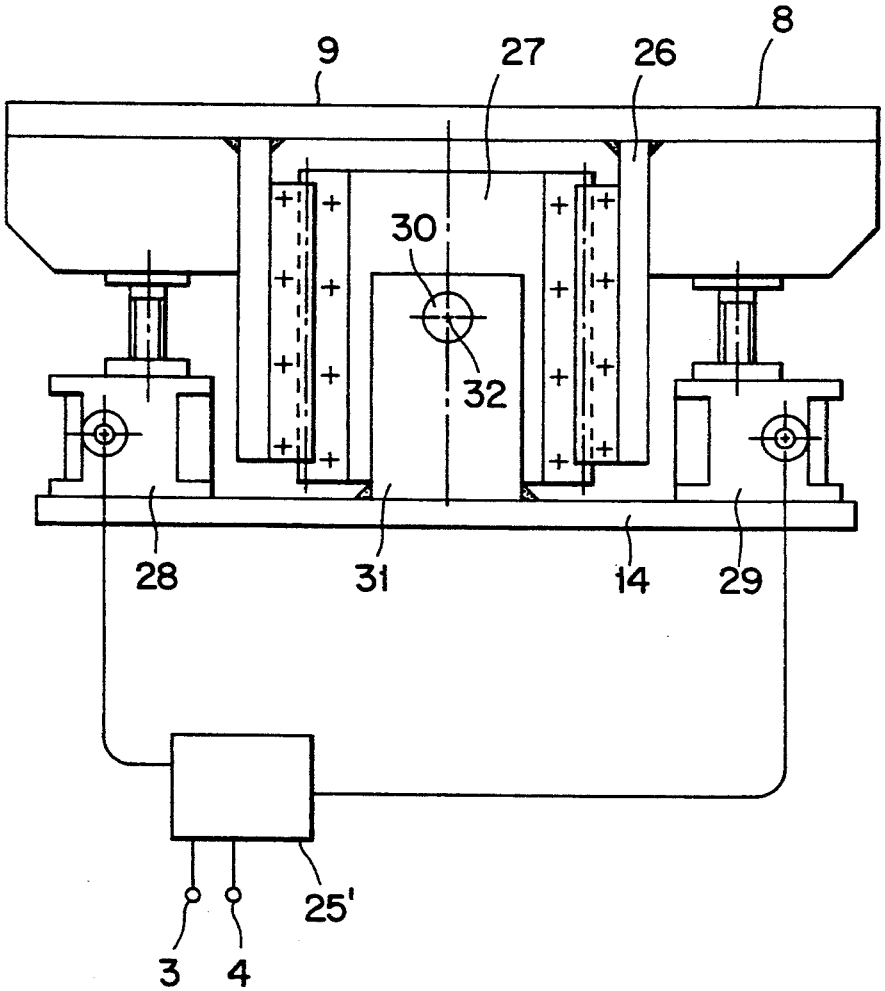
FIG. 6 is a side view corresponding to FIG. 3 of a modified embodiment.

This construction principle is realized in the embodiment according to FIGS. 6 and 7. There the wood guide surface 8 is attached with the pressure bar 9 to a pressure bar slide 26, which can be adjusted vertically in a slide guide holder 27 and thus can be moved at right angles to the cutter blade. For this purpose the pressure bar slide 26 is braced against the machine frame 14 by way of two lifting elements 28, 29, which can be adjusted separately and in essence perpendicularly to the plane of the wood. The two lifting elements 28, 29 are spaced apart in the longitudinal direction of the pressure bar 9 and are formed, for example, by a threaded spindle drive.

The slide guide holder 27 is pivot-mounted by way of a bearing shaft 30 on a bearing block 31, connected to the machine frame 14. The swivel axis 32, formed by the shaft 30, runs at right angles to the pressure bar 9 or the cutter blade 10 and parallel and at a distance from the wood guide surface 8.

If the two lifting elements 28 and 29 are actuated separately, the wood guide surface 8 is swivelled with the pressure bar 9, attached to said wood guide surface, in the manner described above relative to the cutter blade 10, in order to compensate a taper of the square timber 2 in the transverse direction, said taper having been determined by the measurement devices 3, 4. As indicated in FIG. 6, the evaluation circuit 25' controls the two lifting elements 28, 29 as a function of the measurement result of the measurement devices 3, 4.

In addition to the described procedure or irrespective thereof, at least two thickness measurements of the square timber can be conducted by means of the measurement devices 3, 4 or with only one of these two measurement devices 3, 4 at a certain longitudinal distance. To this end, the measurement devices 3, 4 or one of these two measurement devices 3, 4 are actuated once at the start of the square timber 2 and another time at the end of the square timber 2. The measurement values obtained thus give information about the taper of the square timber 2 in the longitudinal direction, i.e. the difference in the thickness at the beginning and the end of the square timber 2.

The measurement result obtained thus is processed in such a manner in the evaluation circuit 25' that the two lifting elements 28, 29 are actuated in such a manner during the travel of the square timber 2 that the distance between the cutter blade 10 and the wood guide surface 8 changes continuously during passage. Thus the determined taper of the square timber 2 in the longitudinal direction is compensated.

If the fed-in square timber 2 exhibits both a taper in the transverse direction and in the longitudinal direction, a state that is determined by the measurement devices 3, 4 in at least two measurement operations every time the square timber 2 travels through, the lifting elements 28, 29 are actuated in such a manner by means of the evaluation circuit 25' that both a swivel adjustment and also a height adjustment of the wood surface guide 8 occurs, said height adjustment occuring continuously during passage.

At variance with the embodiment shown in FIGS. 6 and 7, the adjustment motion controlled by the evaluator 25' can also be carried out at the cutter blade 10, which can be adjusted at right angles for this purpose and may or may not be additionally pivot-mounted on the machine frame 14. It is also possible to separate the swivel adjustment to compensate a taper in the transverse direction and the continuous transverse adjustment during passage of the square timber in such a manner that either the cutter blade 10 or the wood surface guide 8 carries out only the swivel adjustment and the other part carries out only the height adjustment.

We claim:

1. Apparatus for the chipless cutting of wood sheets from a piece of square timber having a longitudinal length and a transverse width, the apparatus comprising:

a wood guide, including a pressure bar, for supporting a piece of square timber for movement, the wood guide engaging a supported side of the timber piece;

a feeding device for conveying the timber piece along the wood guide in a path of travel;

a cutter blade having a cutting edge for cutting a wood sheet from the supported side of the timber piece, the cutting edge extending transversely of the path of travel and being slanted at an oblique angle with respect to the path of travel as viewed in a direction perpendicular to the supported side of the timber piece;

a measuring mechanism arranged to measure a transverse taper of the timber piece by measuring the thickness of the timber piece at least at two transversely spaced locations thereon during conveying of the timber piece; and an adjusting mechanism operably connected to the measuring mechanism for producing a relative pivoting movement between the blade and the wood guide about a pivot axis extending substantially perpendicular to the cutting edge as viewed in a direction perpendicular to the supported side, in accordance with variations in the measured transverse taper of the timber piece.

2. Apparatus according to claim 1, wherein the wood guide is stationary, and the cutter blade is mounted for pivotal adjustment about the pivot axis, the adjusting mechanism being connected to the cuter blade.

3. Apparatus according to claim 1 further including a frame, the wood guide and its pressure bar being rigidly connected to the frame, a blade holder supporting the cutter blade being pivotably mounted to the frame for pivoting about the pivot axis.

4. Apparatus according to claim 3, wherein the pivot axis extends parallel to a plane of the wood guide and at a distance therefrom.

5. Apparatus according to claim 1, wherein the cutter blade is stationary, and the wood guide is mounted for pivotal adjustment about the pivot axis, the adjusting mechanism being connected to the wood guide.

6. Apparatus according to claim 5 further including a frame, the wood guide being mounted to the frame for pivoting about the pivot axis, a blade holder for supporting the cutter blade being rigidly mounted to the frame.

7. Apparatus according to claim 6 including first and second lifting elements connected between the frame and the wood guide on opposite sides of the pivot axis for pivoting the wood guide.

8. Apparatus for the chipless cutting of wood sheets from a piece of square timber, comprising:

a wood guide, including a pressure bar, for supporting a piece of square timber for movement, the wood guide engaging a supported side of the timber piece;

a feeding device for conveying the timber piece along the wood guide in a path of travel;

a cutter blade having a cutting edge for cutting a wood sheet from the supported side of the timber piece, the cutting edge extending transversely of the path of travel and being slanted at an oblique angle with respect to the path of travel as viewed in a direction perpendicular to the supported side of the timber, the depth of cut being determined by a spacing between the cutting edge and the pressure bar;

a measuring mechanism arranged to measure a longitudinal taper of the timber piece by measuring the thickness of the timber piece at least at two longitudinally spaced locations thereon during conveying of the timber piece; and an adjusting mechanism operably connected to the measuring mechanism for changing the spacing between the cutting edge and pressure bar to vary the cutting depth, in accordance with variations in the measured longitudinal taper of the timber piece.

9. Apparatus according to claim 8, wherein the wood guide and pressure bar are stationary, and the cutter blade is adjustable for varying the distance between the cutter blade and the pressure bar.

10. Apparatus according to claim 8, wherein the cutter blade is stationary, and the wood guide and pressure bar are adjustable for varying the distance between the cutter blade and the pressure bar.

11. Apparatus according to claim 10 further including a frame having a holder, the wood guide and pressure bar being slidably mounted in the holder for movement in a direction substantially perpendicular to the cutting blade.

12. Apparatus according to claim 11, wherein the holder is pivotably mounted to the holder by a pivot axis extending substantially perpendicularly to the pressure bar as viewed in a direction perpendicular to the supported side of the timber piece, the pivot axis being parallel to a plane of the wood guide and spaced therefrom.

13. Apparatus according to claim 8 further including a frame, a pair of lifting elements mounted thereon and connected to the wood guide, the lifting elements being spaced apart in a direction parallel to the pressure bar and being simultaneously actuable to vary the distance between the pressure bar and cutting edge.

* * * * *